US009289108B2

(12) United States Patent
Haltmayer et al.

(10) Patent No.: US 9,289,108 B2
(45) Date of Patent: Mar. 22, 2016

(54) CROCKERY BASKET AND DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Jens Schlichtmeier, Günzburg (DE); Martin Weissenburger, Bissingen (DE); Mark Woldenberg, Bachhagel (DE)

(73) Assignee: BSH Hausgeraete GmbH, Munich (DE)

( * ) Notice: Subject to any disclaimer, the term of this patent is extended or adjusted under 35 U.S.C. 154(b) by 1179 days.

(21) Appl. No.: 12/933,090

(22) PCT Filed: Mar. 23, 2009

(86) PCT No.: PCT/EP2009/053394

§ 371 (c)(1),
(2), (4) Date: Sep. 17, 2010

(87) PCT Pub. No.: WO2009/118293

PCT Pub. Date: Oct. 1, 2009

(65) Prior Publication Data

US 2011/0017246 A1 Jan. 27, 2011

(30) Foreign Application Priority Data

Mar. 26, 2008 (DE) ..... 10 2008 015 715

(51) Int. Cl.
*A47L 15/50* (2006.01)

(52) U.S. Cl.
CPC ..... *A47L 15/503* (2013.01); *A47L 15/505* (2013.01)

(58) Field of Classification Search
CPC ... A47L 15/505; A47L 15/503; A47L 15/507; A47L 15/502; A47L 15/0084
USPC ..... 134/56 D, 58 D, 135, 25.2, 57 D, 85; 211/41.8, 41.9, 41.3, 41.2; 312/334.4, 312/228.1, 228, 333
See application file for complete search history.

(56) References Cited

U.S. PATENT DOCUMENTS 3,454,019 A 7/1969 Leedy et al.
7,682,465 B2 * 3/2010 Anderson et al. ..... 134/56 D (Continued)

FOREIGN PATENT DOCUMENTS

DE 7235591 6/1973
DE 29921601 U1 3/2000

(Continued)

OTHER PUBLICATIONS

Kitamura et al., "Basket for Dishwasher" Oct. 1998, JP 10-033454—Machine Translation.*

(Continued)

*Primary Examiner* — Michael Barr
*Assistant Examiner* — Thomas Bucci
(74) *Attorney, Agent, or Firm* — James E. Howard; Andre Pallapies

(57) ABSTRACT

A crockery basket of a dishwasher for receiving pieces of crockery. The crockery basket has a bottom; a plurality of lateral parts framing the bottom; and at least two substantially parallel rows of rods that are arranged on the bottom to hold the pieces of crockery. Each of the at least two rows of rods has a base wire and individual rod wires that are attached to the base wire. At least two adjacent individual rod wires of a first of the at least two rows of rods have a bend in a direction of a second of the at least two rows of rods.

20 Claims, 1 Drawing Sheet

(56) References Cited

U.S. PATENT DOCUMENTS

| | | | | |
|---|---|---|---|---|
| 7,931,155 | B2 * | 4/2011 | Bastuji | 211/41.9 |
| 8,408,403 | B2 * | 4/2013 | Hedstrom et al. | 211/41.8 |
| 2007/0226928 | A1 | 10/2007 | Bastuji | |
| 2008/0302740 | A1 * | 12/2008 | Moser et al. | 211/41.8 |

FOREIGN PATENT DOCUMENTS

| | | | | | |
|---|---|---|---|---|---|
| EP | 1665975 | A1 | | 6/2006 | |
| JP | 10033454 | A | * | 2/1998 | A47L 15/50 |
| JP | 2000279363 | A | * | 10/2000 | A47L 15/50 |
| JP | 2001231737 | A | | 8/2001 | |
| JP | 2003180607 | A | | 7/2003 | |
| JP | 2004041686 | A | | 2/2004 | |
| JP | 2007136015 | A | | 6/2007 | |

OTHER PUBLICATIONS

Kitamura et al., JP 10-033454, Partial Human Translation of paragraph [0005].*

Kitamura et al., "Basket for Dishwasher" Oct. 1998, JP 10-033454 (Machine Translation).*

Wakatsuki, "Tableware Basket for Dishwashing and Drying Machine" Oct. 2000, JP 2000-279363 (Machine Translation).*

* cited by examiner

CROCKERY BASKET AND DISHWASHER

BACKGROUND OF THE INVENTION

The present invention relates to a crockery basket of a dishwasher for receiving pieces of crockery, comprising a bottom and lateral parts framing the bottom, at least two substantially parallel rows of rods for holding the pieces of crockery being arranged on the bottom, each row consisting of at least one base wire for the rods and at least one row of rods which is fixed to the base wire and consists of individual rod wires, and to a dishwasher comprising a corresponding crockery basket.

A crockery basket is known from DE 72 35 591 U which comprises a bottom framed by lateral parts. Bottom and lateral parts consist of individual wires that are connected to each other. Parallel corrugated wires are provided on the bottom of the crockery basket for receiving pieces of crockery, on which wires rod wires are securely arranged by one end respectively. The other end of the respective rod wire protrudes freely into the interior of the basket. The corrugated wires, together with the rod wires, are used to receive pieces of crockery. One drawback of this design of a crockery basket is the expensive manufacture of the crockery basket owing to the corrugated wires. The corrugated wires, which are located in the base region, have the further drawback that pieces of crockery, in particular small plates, received between the corrugated wires and the rod wires protrude into a region below the crockery basket. Consequently, it is not possible to rule out damage to the pieces of crockery due to a spray arm, which is often arranged below the crockery basket. Additionally, due to the design of the rod wires it is difficult to fill the crockery basket with substantially cylindrical pieces of crockery, such as glasses for example. The glasses are received only unstably and may be damaged during the washing process.

A crockery basket for dishwashers is known from DE 299 21 601 U1 in which a row of rods for holding the pieces of crockery is arranged on the bottom. The row of rods comprises a rod base wire and a row of rods secured thereto comprising individual rod wires. The rod base wire is located on the bottom of the crockery basket, which is a wire mesh. The pieces of crockery are held by two rows of rods between two rod wires respectively. The row of rods can be folded down if required and positioned against the bottom. Support is provided by way of additional bent wires in the base mat of the crockery basket, which wires surround the rod base wire. One drawback of this is that the bearing point is simultaneously the point at which the piece of crockery is to be held. This does not ensure that the piece of crockery is held stably and so as to be protected. If the pieces of crockery are, by way of example, small plates or glasses they protrude through the base mat of the crockery basket and can be damaged as a result of a movement of a spray arm, which is arranged in the dishwasher below the mesh basket. Additionally, the piece of crockery may touch the base mat wires of the bottom of the crockery basket resulting in the piece of crockery being held only unstably and possibly likewise being damaged. Cylindrical pieces of crockery, such as glasses or tumblers, are not stably held by the rod wires even when the row of rods is erected, and may be damaged as a result.

BRIEF SUMMARY OF THE INVENTION

The object of the present invention is to avoid the above-described drawbacks and to ensure stable positioning of a piece of crockery, in particular of a substantially cylindrical piece of crockery, in the crockery basket, to avoid damage to the piece of crockery in the process and to improve the washing performance and drying. The crockery basket should, moreover, be flexible in terms of its loading possibilities.

The object is achieved by a crockery basket and a dishwasher with the features of the independent claims.

According to the invention a crockery basket of a dishwasher for receiving pieces of crockery comprises a bottom and lateral parts framing the bottom. At least two substantially parallel rows of rods for holding the pieces of crockery are arranged on the bottom. Each row of rods comprises at least one rod base wire and at least one row of rods secured thereto and comprising individual rod wires. At least two adjacent rod wires of a row of rods have a bend in the direction of the second row of rods. The individual rod wires are connected to a connecting wire at a spacing from the rod base wire. The bend is spaced from the bottom when the rows of rods are erected. The bend produces a support point for the, in particular, cylindrical piece of crockery, for example a tumbler or a glass. The edge of the piece of crockery is placed on the bend and the part of the piece of crockery spaced apart from the edge is supported on the adjacent row of rods. Consequently the piece of crockery is located at an angle between the two rows of rods but is still stably held. Damage to the piece of crockery is reliably avoided as a result. Instead of glasses, plates may be received between four rod wires of two adjacent rows of rods.

At least one end of the rod base wire is preferably folded, i.e. bent and rotatably mounted on the bottom. By securing the rod base wire to the bottom a row of rods that may be folded with respect to the bottom is produced in the crockery basket. The crockery basket itself is very versatile as a result. When the rows of rods are erected plates or bowls for example, and owing to the bend in the rod wires, even glasses, may be received in an organized and, for improved cleaning and to avoid damage, spaced-apart manner between the rod wires. The row of rods can be folded back in order to clean larger pieces of crockery and therefore create space for receiving saucepans by way of example.

The crockery basket constructed according to the invention makes it possible to securely position a cylindrical piece of crockery in particular, for example a glass or a cup, in a row of rods which is originally designed for plates and bowls. The piece of crockery is easily and inexpensively held between the rod wires without additional wires or additional parts and preferably with a spacing of a piece of crockery from the bottom of a dishwasher basket. In a preferred embodiment of the invention the cylindrical pieces of crockery are not held in the plane of the bottom but in a plane located thereabove, whereby parts of the pieces of crockery that protrude downwards advantageously remain inside the crockery basket. This means the pieces of crockery are stably held and in turn are therefore protected from damage, and the pieces of crockery outside of the crockery basket are also prevented from being damaged by moved parts inside the dishwasher. This also prevents the pieces of crockery from hitting housing parts of the dishwasher, as the crockery basket is being removed from and inserted into the dishwasher, and from being damaged in the process.

The inventive holding of the pieces of crockery in the rows of rods is achieved without substantial additional expenditure during production of the crockery basket. The bend in the rod wires means that the place at which the pieces of crockery are held is elevated with respect to the bottom. If the cylindrical pieces of crockery are at least partially placed and held on the bend in the rod wires these pieces of crockery, and in particular glasses, tumblers or cups, protrude into the region between bend and rod base wire or bottom but not below the bottom. They are therefore protected against damage from below. Conventionally only flat items may be positioned in rows of rods which are designed for plates. An unfavorable positioning angle results for glasses or cups and they can therefore not be optimally arranged in the crockery basket. In contrast thereto, holding a piece of crockery between at least two adjacent rows of rods, which are constructed according to the inventive principle, makes it possible to arrange even cylindrical pieces of crockery in a row of rods for plates and bowls in an ideal situation for the washing result and drying. This makes the crockery basket even more flexible for the customer.

The pieces of crockery are ideally held by two identical rows of rods. The cylindrical items of crockery can consequently be placed on the bend of one row of rods or the other row of rods running parallel thereto. Each individual piece of crockery is in particular arranged on two parallel rows of rods and between a total of four rod wires. The piece of crockery is therefore preferably held above the bottom. A flexible division of the crockery basket is achieved if the row of rods is optionally expediently also rotatably mounted.

The bottom advantageously consists of a base mat made of wire. This base mat, which substantially corresponds to a wire mesh, is inexpensive to produce and ensures good accessibility to the piece of crockery for the cleaning fluid as well as good drying of the piece of crockery. The base mat made of wire enables good stability of the crockery basket with the lowest possible covering of the piece of crockery with respect to the cleaning fluid, as well as optimum dripping of the piece of crockery that is drying.

A particularly simple connection between base mat of the bottom and rod base wire of the rows of rods is achieved if, with it ends, the base wire is arranged on the bottom or on the base mat, in particular by means of a respective pivot bearing element. The pivot bearing element can either be formed preferably by the shaping of the wires with respect to each other, or, in particular, a separate pivot bearing element is used which is connected to the bottom or the base mat and rotatably guides the rod base wire. The row of rods is therefore flexibly arranged in the crockery basket and consequently enables the pieces of crockery to be stably held on the one hand, and a large-volume space without division, in which even large pieces of crockery may be supported and cleaned, to be created on the other.

If one of the bearing elements for rotatable mounting of the row of rods is, in particular, a movable bearing and the other bearing element preferably a fixed bearing for the base wire, resulting manufacturing tolerances in the bearing elements, the fastening points of the bearing elements to the bottom or the base mat and the row of rods to the rod base wire may therefore advantageously be easily compensated.

The bend is advantageously arranged at a spacing from the bottom. This ensures that even if the cylindrical piece of crockery is positioned at an angle, no part of the piece of crockery passes into the region of the bottom of the crockery basket or protrudes through it even. This prevents the piece of crockery from being damaged and ensures stable mounting of the piece of crockery.

The row of rods is held in the appropriate position, in particular in the upright position, if the bearing element advantageously comprises a catch for the end of the base wire for the rods. The pieces of crockery can therefore be easily introduced into the rows of rods without the rods attempting to fold back. Only with an intentional rotation of the row of rods can the row be moved from the first latched position into the other position by a relatively high application of force.

It is advantageous if the bend is a double bend in particular. This alone produces a support point for cylindrical pieces of crockery. The bend should be made such that it points in the direction of the second row of rods. The space between the two rows of rods is narrowed as a result and forms a receiving location for the cylindrical piece of crockery. The two end pieces of the rod wire do not extend parallel when the bend is produced as a double bend. If parallelism of the ends of the rod wire should remain ensured, it is advantageous if the bend is achieved by a triple bend. The bend is then formed in the shape of a U. The piece of crockery is placed on the leg pointing toward the free end of the rod wire.

The two ends of the rod base wire advantageously comprise regions that are aligned with each other and which form the rotational axis of the row of rods. Special components or measures are no longer necessary as a result. It is advantageously possible to rotate the rows of rods by the shaping of the base wire alone.

If the bend is arranged at a spacing from the base wire or bottom of the crockery basket this produces a corresponding spacing of the holding points for the piece of crockery. The cylindrical piece of crockery is received between two rows of rods, is located between a total of four rod wires and rests on the two bends in the first row of rods and at the tips of the second row of rods. The piece of crockery is stably received as a result and is protected against damage, moreover.

If the first spacing of the bend from the bottom and a further spacing of the bend from the tips of the associated rod wires of the adjacent second row of rods are coordinated with each other in particular in such a way that glasses that are to be received are held at an angle of preferably at least 20°, preferably at an angle of about 30°, this means that no water marks are produced as the pieces of crockery are dried. The water can drain in good time and does not accumulate. The drying result is consequently very good.

If the first spacing and the further spacing of the bend from the tips of the associated rod wires of the adjacent second row of rods are advantageously coordinated with each other in such a way that glasses that are to be received do not protrude through the bottom of the crockery basket or touch the wires of the base mat, damage to the pieces of crockery when inserting the crockery basket into the dishwasher or by the spray arm is effectively avoided.

The rod wires are preferably obliquely oriented in relation to the base wire. This makes it easier to receive voluminous pieces of crockery, and both cleaning and drying of the pieces of crockery is improved by the angled positioning of the pieces of crockery. The angled positioning of the pieces of crockery means that no, or only a few, places are created on the piece of crockery which extend horizontally, so the water can drain quickly and without leaving behind drying marks.

A dishwasher comprising at least one above-described crockery basket is inexpensive to produce and delivers very good cleaning and drying results of the pieces of crockery located therein.

By producing an inventive bend in the rod wires the present invention makes for versatile filling of the crockery basket with different pieces of crockery and a spacing from the base mat of the crockery basket prevents undefined support points being produced on the piece of crockery, whereby the washing performance and drying are improved. Whereas in comparable dishwashers only flat items are positioned in rows of rods that are designed for plates, glasses and cups cannot be optimally positioned owing to the unfavorable positioning angle. With the invention it is possible to arrange even cylindrical pieces of crockery in rows of rods for plates and bowls in an ideal situation for the washing result and drying.

Other developments of the invention are recited in the subclaims.

BRIEF DESCRIPTION OF THE DRAWINGS

The invention and its developments and the further advantages thereof will be described in more detail below with reference to drawings, in which schematically.

DETAILED DESCRIPTION OF EXEMPLARY EMBODIMENTS OF THE PRESENT INVENTION

Figure 1:
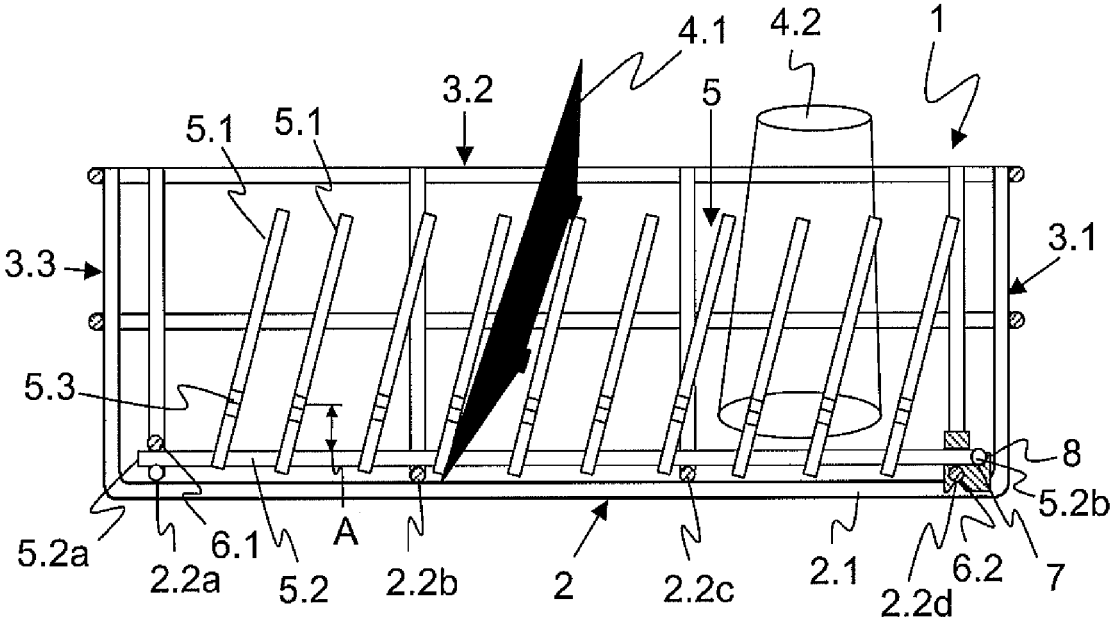
FIG. 1 shows a cut through a crockery basket.

FIG. 1 is a schematic cut through a crockery basket 1 constructed according to the invention. The crockery basket 1 comprises a base mat 2, which forms the bottom of the crockery basket 1. The bottom is framed by lateral parts 3.1, 3.2 and 3.3. A fourth lateral part is not shown. The lateral parts 3.1, 3.2 and 3.3, like the base mat 2 of the bottom, consist of wires that are connected to each other crosswise. These wires cause low screening of the pieces of crockery to be cleaned and therefore also very good drying of the pieces of crockery as no banked-up water forms. An item of crockery 4 is schematically shown in the crockery basket 1.

The base mat 2 consists of longitudinal wires 2.1 and cross wires 2.2*a* to 2.2*d*. At least two rows 5 of rods are provided, of which only one may be seen in this view, for receiving pieces of crockery 4.1 and 4.2. Each row 5 of rods consists of a large number of rod wires 5.1 which are secured to a rod base wire 5.2. In the present exemplary embodiment the rod wire 5.1 is obliquely secured, in particular welded, to the rod base wire 5.2. The rod wire can also be secured to the rod base wire 5.2 at a right angle and be bent further on. The bend means that the piece of crockery 4.1, which is a plate in the present case, is held at an angle, so no banked-up water forms on the piece of crockery 4.1 and therefore no drying marks occur. All essential surfaces of the held piece of crockery 4.1 are preferably inclined at an angle of about 30° with respect to the horizontal, so the water can easily drain from the piece of crockery 4.1. The piece of crockery 4.1 is held between two rod wires 5.1 of a row 5 of rods. In the process it is also supported on the rod base wire 5.2 which connects the row of rod wires 5.1 to each other.

The rod base wire 5.2 is bent at one end. The ends are in turn rotatably mounted on the bottom via bearing elements 6.1 and 6.2. The bearing element 6.2 is designed as a fixed bearing and the bearing element 6.1 as a movable bearing.

In the present exemplary embodiment the rod base wire 5.2 ends in a straight line at its left-hand end piece 5.2*a*. The end piece 5.2*a* is mounted in the movable bearing 6.1 so as to be rotatable and longitudinally movable. Manufacturing tolerances in the individual parts of the dishwasher basket 1 may be compensated hereby. The bearing element 6.1 consists of a triple bend of the cross wire 2.2*a* of the base mat 2 which consequently produces an eye into which the end piece 5.2*a* is inserted. The end piece 5.2*a* is rotatably mounted in the eye.

In the present exemplary embodiment there is a single bend at the other end of the rod base wire 5.2. The rod base wire 5.2 upstream of the end piece 5.2*b* forms a rotational axis for the row 5 of rods. It is rotatably arranged in a fixed bearing 6.2 and consequently positions the row 5 of rods in the longitudinal direction. The bearing element 6.2 is connected, in particular snap-fitted, to the bottom, in this case by the cross wire 2.2*d* of the base mat 2. As a result of this design with a movable bearing 6.1 and a fixed bearing 6.2 tolerances of several millimeters, which are not essential to the function of the row 5 of rods, may be compensated. Manufacture of the crockery basket 1 and the row 5 of rods is significantly simplified, however, and may be carried out more inexpensively.

The bend, which in this exemplary embodiment is in a plane at right angles to the plane of the rod wires 5.1, causes the end piece 5.2*b* to be bent out of the drawing plane. When the row 5 of rods is in the erected position the end piece 5.2*e* is located on a support of the bearing element 6.2 and forms a stop 7. The row 5 of rods can only be erected to the extent that the stop 7 and the end piece 5.2*b* allow. Folding of the row 5 of rods is only possible in one direction if the end piece 5.2*b* moves away from the stop 7 on the bearing element 6.2. This ensures that the row 5 of rods is not folded-up too far.

In the position in which it rests on the stop 7 the end piece 5.2*b* is secured by means of a catch 8. Only by way of a deliberate application of force does the end piece 5.2*b* overcome this catch 8 and allow the row 5 of rods to be folded.

The rod wire 5.1 has a triple bend 5.3. This produces a shoulder which can be used as a support for pieces of crockery 4.2 which cannot be received between the above-described four rod wires 5.1, in other words, which are not as thin as plates, for example. The triple bend 5.3 is arranged [on] each rod wire 5.1 in such a way that it extends at a spacing A from the bottom or base mat 2. The spacing A from the rod base wire 5.2 in particular means that pieces of crockery 4.2, which are to be received in the row 5 of rods, do not have any contact with the base mat 2 or bottom and do not protrude through the base mat 2 or bottom either. This ensures that, for example, spray arms, which move below the base mat 2, do not come into contact with the piece of crockery 4.2 and potentially lead to damage thereof. Additionally, the use of two parallel rows 5 of rods means the piece of crockery 4.2 is stably received, as will be described in more detail in the following figures.

The piece of crockery 4.2 in this case a glass, rests with its edge on two double bends 5.3. The glass can be cleaned from below by a spray arm (not shown). It is supported on the parallel row 5 of rods and is consequently located at an angle in the crockery basket 1. Ideally, level surfaces, for example the bottom of the piece of crockery 4.2, are inclined at an angle to the horizontal. The angle for the intended pieces of crockery is preferably at least 20°, ideally about 30°. The spacing A and a further spacing B of the bend from the tips of the associated rod wires 5.1 of the adjacent second row 5 of rods are coordinated with each other in such a way that glasses to be received do not protrude through the bottom of the crockery basket 1 or touch the wires 2.1 and 2.2 of the base mat.

Figure 2:
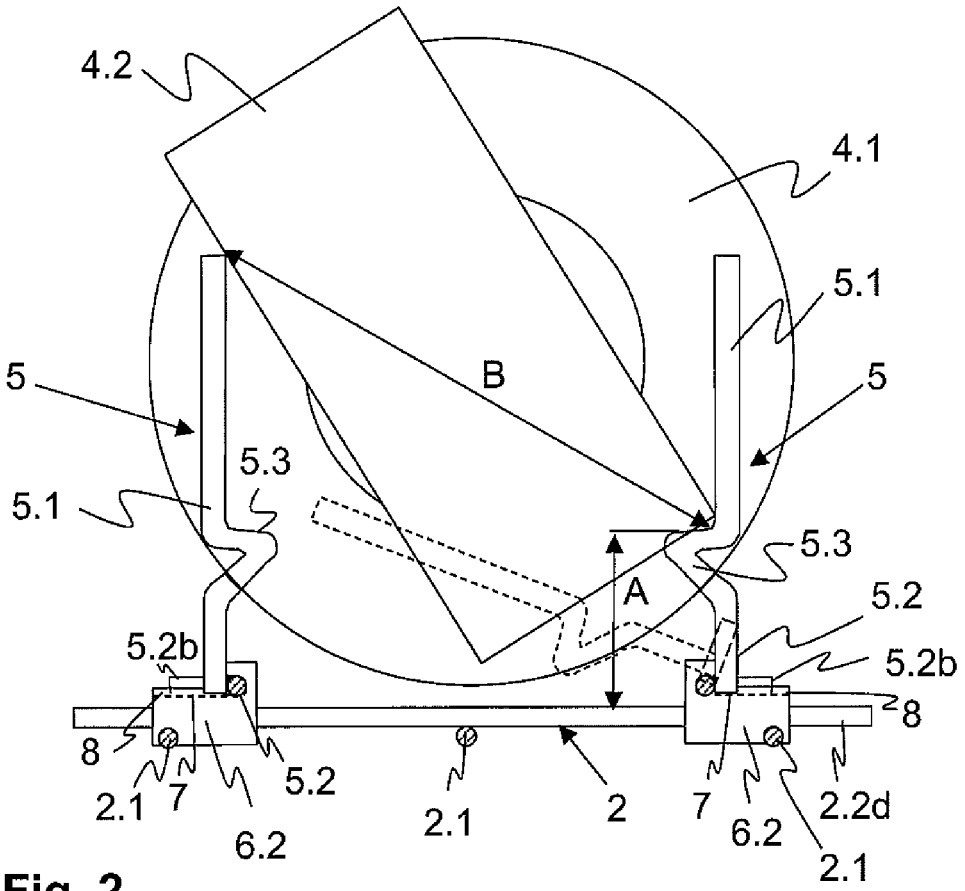
FIG. 2 shows a cut through two parallel rows of rods.

FIG. 2 accordingly shows a detail in a view transverse to the illustration of FIG. 1. The round piece of crockery 4.1, in this case a plate, and a substantially cylindrical piece of crockery 4.2, in this case a glass, are shown. The piece of crockery 4.2 is supported on the rod wires 5.1 of the two rows 5 of rods. The glass edge is located on the triple bend 5.3 and the cylinder circumferential surface is located on the opposing row 5 of rods on two further rod wires 5.1. The triple bend 5.3 is located at a spacing A from the rod base wire 5.2 in order to prevent the piece of crockery 4 from coming into contact with the cross wire 2.2*d*. Depending on the design and arrangement of the row 5 of rods in relation to the cross wires 2.2*a* to 2.2*d* and the longitudinal wires 2.1, the spacing can be determined as a spacing between the connecting wire 5.3 and the longitudinal wire 2.1 or as a spacing between the connecting wire 5.3 and the cross wire 2.2*a* to 2.2*d*. In any case it is advantageous when there is no contact between the provided piece of crockery 4.2 and one of the longitudinal wires or cross wires 2.1, 2.2.

The end of the rod base wire 5.2 is bent and consequently forms a bearing pin for the bearing element 6.2 and an end piece 5.2*b* for the stop 7. The stop 7 cooperates with the end piece 5.2*b* when the row 5 of rods is in the folded-up position. The illustration in broken lines shows the right-hand row 5 of rods in the position where it is not fully folded. In the process the end piece 5.2*b* shifts from a horizontal to a vertical position, while the rod wires 5.1 come to rest horizontally. A catch 8 may be provided for a fixed end setting in both the unfolded-up and folded-down positions.

The ends of the rod base wire 5.2 are provided with a bend on one side and run in a straight line at the other side. A stop in the horizontal direction is consequently produced on the side with the single bend due to the cooperation with the fixed bearing 6.2, and by means of the straight end a fastening that is variable in length is produced on the other side due to the movable bearing 6.1 which is an eye of the cross wire 2.2*a*. Manufacturing tolerances are compensated by these two different bearings 6.1 and 6.2. The bearing element 6.2 is preferably arranged at the intersecting point of the cross wires 2.2*d* and the longitudinal wires 2.1. Stable securing of the bearings in the crockery basket 1 is achieved hereby. In this exemplary embodiment the end pieces 5.2*b* are guided on both sides by the fixed bearing element 6.2. They are held in position by means of the catch 8.

The row 5 of rods is flexibly arranged on the bottom, in this case on the base mat 2. The piece of crockery 4 is held between two rows 5 of rods by the rod wires 5.1. Contact with the bottom of the crockery basket 1 is avoided by the spacing of the triple bend 5.2 from the bottom of the crockery basket 1 when using the provided piece of crockery 4.2.

The present invention is not limited to the illustrated exemplary embodiments. In particular, double bends on the rod wires are possible. Securing to the rod base wire is then at an angle. It is particularly advantageous when no additional bent or folded wire is required. Simple production, which is integrated into rod manufacture in a fully or partially automated manner, with only short expenditure of time to fold or bend the wires, and therefore a clear cost saving compared with known rows of rods, is achieved hereby. The rows of rods may also have a different construction, in particular they may be fitted with a different pivot mechanism or also be secured to the bottom of the mesh basket so as to be fixed and therefore non-rotatable.

LIST OR REFERENCE CHARACTERS

1 crockery basket
2 base mat
2.1 longitudinal wire
2.2*a-d* cross wire
3.1-3.3 lateral parts
4.1 flat piece of crockery
4.2 cylindrical piece of crockery
5 row of rods
5.1 rod wire
5.2 rod base wire
5.2*a* end piece
5.2*b* end piece
5.3 triple bend
6.1, 6.2 bearing elements
7 stop
8 catch
A spacing
B spacing

The invention claimed is:

1. A crockery basket of a dishwasher for receiving crockery, the crockery basket comprising:

a base;

a first base wire and a second base wire, the first base wire and the second base wire supported above the base, and the first base wire and the second base wire being substantially parallel; and a first plurality of rod wires, each of the first plurality of rod wires having a first rod wire free end, and each of the first plurality of rod wires attached to the first base wire opposite the first rod wire free end; and a second plurality of rod wires, each of the second plurality of rod wires having a second rod wire free end, and each of the second plurality of rod wires attached to the second base wire opposite the second rod wire free end, wherein at least two adjacent ones of the first plurality of rod wires are bent in a first direction toward the second plurality of rod wires and perpendicular to the first base wire to define support points, wherein at least two adjacent ones of the second plurality of rod wires are bent in a second direction toward the first plurality of rod wires and perpendicular to the second base wire to define additional support points, wherein the support point of each of the at least two adjacent ones of the first plurality of rod wires and the additional support point of each of the at least two adjacent ones of the second plurality of rod wires are defined by a triple bend, wherein a portion of each triple bend that defines each support point and each additional support point is bent substantially perpendicular to the longitudinal axis of the corresponding rod wire, and wherein each support point is raised from the base such that the crockery does not contact the base when supported by the support point of each of the at least two adjacent ones of the first plurality of rod wires and the second rod wire free end of at least two of the second plurality of rod wires.

2. The crockery basket of claim 1, wherein the base comprises a plurality of longitudinal wires and a plurality of cross wires.

3. The crockery basket of claim 2, wherein each end of the first base wire and the second base wire is coupled to the base by a pivot bearing element, each pivot bearing element allowing the first base wire and the second base wire to rotate about a respective longitudinal axis.

4. The crockery basket of claim 3, wherein one of the pivot bearing elements is a movable bearing and the other pivot bearing element is a fixed bearing to prevent the first base wire and the second base wire from moving a direction parallel to the respective longitudinal axis.

5. The crockery basket of claim 3, wherein each fixed bearing has a catch for a respective end of the first base wire and the second base wire.

6. The crockery basket of claim 1, wherein each support point is lower than a corresponding second rod wire free end relative to the base such that the crockery is held at an angle when supported by the support point of each of the at least two adjacent ones of the first plurality of rod wires and the second rod wire free end of at least two of the second plurality of rod wires.

7. The crockery basket of claim 6, wherein the angle is at least 20°.

8. The crockery basket of claim 7, wherein the angle is about 30°.

9. The crockery basket of claim 1, wherein each of the first plurality of rod wires is oriented relative to the first base wire at an oblique angle and each of the second plurality of rod wires is oriented relative to the second base wire at an oblique angle.

10. A crockery basket for supporting crockery in a dishwasher, comprising:

a base;

a first base wire and a second base wire, the first base wire and the second base wire supported above the base, and the first base wire and the second base wire being substantially parallel; and a first plurality of rod wires, each of the first plurality of rod wires having a first rod wire free end, and each of the first plurality of rod wires attached to the first base wire opposite the first rod wire free end; and a second plurality of rod wires, each of the second plurality of rod wires having a second rod wire free end, and each of the plurality of rod wires attached to the second base wire opposite the second rod wire free end, wherein at least two adjacent ones of the first plurality of rod wires have at least one first bend extending toward the second plurality of rod wires and defining a support point, wherein at least two adjacent ones of the second plurality of rod wires have at least one second bend extending opposite the at least one first bend toward the first plurality of rod wires and defining an additional support point, wherein the support point of each of the at least two adjacent ones of the first plurality of rod wires and the additional support point of each of the at least two adjacent ones of the second plurality of rod wires are defined by a triple bend, wherein a portion of each triple bend that defines each support point and each additional support point is bent substantially perpendicular to the longitudinal axis of the corresponding rod wire, and wherein each support point is lower than a corresponding second rod wire free end relative to the base such that the crockery is held at an angle when supported by the support point of each of the at least two adjacent ones of the first plurality of rod wires and the second rod wire free end of at least two of the second plurality of rod wires.

11. The crockery basket of claim 10, wherein the base comprises a plurality of longitudinal wires and a plurality of cross wires.

12. The crockery basket of claim 11, wherein each end of the first base wire and the second base wire is supported on the base by a pivot bearing element, each pivot bearing element allowing the first base wire and the second base wire to rotate about a respective longitudinal axis.

13. The crockery basket of claim 12, wherein one of the pivot bearing elements is a movable bearing and the other pivot bearing element is a fixed bearing to prevent the first base wire and the second base wire from moving a direction parallel to the respective longitudinal axis.

14. The crockery basket of claim 12, wherein each fixed bearing has a catch for a respective end of the first base wire and the second base wire.

15. The crockery basket of claim 10, wherein the support point is raised from the base such that the crockery does not contact the base when supported by the support point of each of the at least two adjacent ones of the first plurality of rod wires and the second rod wire free end of at least two of the second plurality of rod wires.

16. The crockery basket of claim 10, wherein the angle is at least 20°.

17. The crockery basket of claim 16, wherein the angle is about 30°.

18. The crockery basket of claim 10, wherein each of the first plurality of rod wires is oriented relative to the first base wire at an oblique angle and each of the second plurality of rod wires is oriented relative to the second base wire at an oblique angle.

19. The crockery basket of claim 1, wherein each of the first plurality of rod wires and each of the second plurality of rod wires has an upper portion above the triple bend and a lower portion below the triple bend, and wherein the upper portion and the lower portion of each of the first plurality of rod wires and each of the second plurality of rod wires are parallel.

20. The crockery basket of claim 10, wherein each of the first plurality of rod wires and each of the second plurality of rod wires has an upper portion above the triple bend and a lower portion below the triple bend, and wherein the upper portion and the lower portion of each of the first plurality of rod wires and each of the second plurality of rod wires are parallel.

* * * * *